US010490076B2

(12) United States Patent
Papineau et al.

(10) Patent No.: US 10,490,076 B2
(45) Date of Patent: Nov. 26, 2019

(54) VEHICLE PARKING SPACE OCCUPANCY VERIFICATION AND USE AUTHORIZATION

(71) Applicants: Michael Papineau, East Toronto (CA); Mark Feltham, East Toronto (CA)

(72) Inventors: Michael Papineau, East Toronto (CA); Mark Feltham, East Toronto (CA)

( * ) Notice: Subject to any disclaimer, the term of this patent is extended or adjusted under 35 U.S.C. 154(b) by 0 days.

(21) Appl. No.: 15/878,308

(22) Filed: Jan. 23, 2018

(65) Prior Publication Data

US 2019/0228659 A1 Jul. 25, 2019

(51) Int. Cl.
*G08G 1/14* (2006.01)

(52) U.S. Cl.
CPC ..... *G08G 1/144* (2013.01)

(58) Field of Classification Search
CPC ..... G08G 1/146; G08G 1/141; G06Q 10/02
See application file for complete search history.

(56) References Cited

U.S. PATENT DOCUMENTS

2012/0044091 A1* 2/2012 Kim ..... G08G 1/143 340/932.2
2012/0285790 A1* 11/2012 Jones ..... G07B 15/02 194/217
2017/0249625 A1* 8/2017 Vossoughi ..... G07B 15/02
2017/0300803 A1* 10/2017 Beavers ..... G06Q 30/00

* cited by examiner

*Primary Examiner* — Omeed Alizada
(74) *Attorney, Agent, or Firm* — John L. Sotomayor

(57) ABSTRACT

The present invention is a method and system to verify the availability and location of parking spaces within a fixed physical area, and to confirm that subsequent occupiers are authorized to use the space. In an embodiment the present invention uses a parking sensor coupled with a beacon to notify parking authorities and users of a particular mobile application when an individual parking space is unoccupied. In the event of subsequent unauthorized occupying of any particular parking space, the present invention communicates information regarding the same to parking authorities for enforcement.

18 Claims, 5 Drawing Sheets

VEHICLE PARKING SPACE OCCUPANCY VERIFICATION AND USE AUTHORIZATION

CLAIM TO PRIORITY

This Non-Provisional application claims under 35 U.S.C. § 120, the benefit as a Continuation In Part of the non-Provisional application Ser. No. 15/789,503, filed Oct. 20, 2017, Titled "Vehicle Occupancy Verification Utilizing Proximity Confirmation" which is hereby incorporated by reference in its entirety.

COPYRIGHT AND TRADEMARK NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever. Trademarks are the property of their respective owners.

BACKGROUND

Many municipalities and private organizations struggle with managing motor vehicle commuter use of the finite number of parking spaces available in any particular lot, community, or jurisdiction. At the same time, commuters driving cars, vans, sport utility vehicles and the like, struggle to find open and available parking spaces in popular locales.

Separately, municipalities and private organizations may desire to reserve parking spaces in choice locations as "rewards" for certain individuals or to serve as consideration in a pay-per-use revenue generating scenario.

In order to reserve and manage parking spaces, some entities have employed static signage to indicate that select spaces are considered to be "reserved" for use only during certain hours or only by vehicles bearing certain indicia of privilege, such as a decal or tag placed prominently in or on the authorized vehicle. Such a system requires active policing for non-compliance, such policing often taking the form of physical parking wardens who, while performing a circuit of all parking spaces in a given area, write citations to unauthorized users or take other corrective action.

Other entities employ physical barriers such as walls or toll gates to limit access to privileged parking areas. By tracking the number of vehicles granted admission to such areas and by ensuring that the number admitted in any particular interval does not exceed the maximum number of available spaces, entities can guarantee that drivers of admitted vehicles will secure suitable parking.

BRIEF DESCRIPTION OF THE DRAWINGS

Certain illustrative embodiments illustrating organization and method of operation, together with objects and advantages may be best understood by reference detailed description that follows taken in conjunction with the accompanying drawings in which.

DETAILED DESCRIPTION

Figure 1:
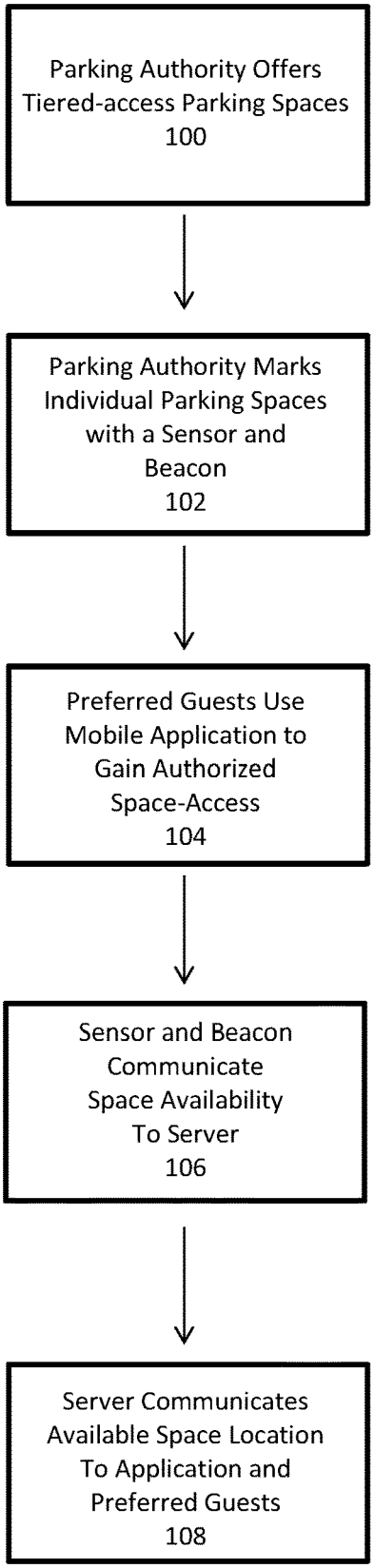
FIG. 1 is a process flow diagram for an exemplary system operation consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one, or more than one. The term "plurality", as used herein, is defined as two, or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an exemplary embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

References herein to "device" indicate electronic devices that include a radio frequency (RF) transmitter, and contemplate but are not limited to include a mobile phone, a laptop, an electronic tablet, or any personal digital assistance device.

References to "GPS" indicate reference to the Global Positioning System space-based radio-navigation satellite array and associated technologies.

References herein to "Tiered-access" contemplate physical spaces differentiated in permissive occupation by privileged drivers based upon pre-determined criteria.

References herein to "sensor" include presence-detection devices based on optic detection principles, magnetic detection principles, or a combination of optic and magnetic detection principles. Each sensor may have a wireless broadcast capability for data communication with other devices.

References herein to "beacon" refer to a wired or wireless broadcast device such as, by way of non-limiting example, i-beacon or eddystone.

In order to offer public parking, municipalities and private entities are often faced with the need to maximize the availability of a finite and coveted resource. Because of their physical size, the number of parking spaces for motor vehicles in a particular area is inherently limited by the size of the motor vehicles and the size of the area in question. Thus, when demand for parking in a given locale outstrips supply, rationing access to those spaces becomes a necessity.

This necessity is compounded in the case where municipalities or private entities intend to offer certain select parking spaces to an authorized subset of the driving public. For instance, some entities may desire to offer parking spaces located close to a building entrance to the elderly or disabled. Others may desire to offer spaces near a business based upon paid access only, or as a perk for loyal customers or employees. In fact, entities may desire to reserve parking spots for any number of customers determined to be "privileged": expectant mothers, parents with small children, or valet parking "VIP" drivers.

In order to ration such a finite resource as desirable parking spaces, entities must create a physical or procedural infrastructure to police for unauthorized use of parking spaces. Municipalities have historically chosen to use such costly physical infrastructure as walls or toll gates, while using procedural infrastructure such as selling indicia of authorization and hiring human monitors to look for vehicles not bearing such indicia and towing offending vehicles or levying fines on associated drivers.

Simultaneously, drivers seeking parking spaces are often at a disadvantage in finding a single authorized space within a set number of spaces with varying permission requirements. For instance, the holder of an exemplary authorized parking permit "A" may be stymied by the availability of parking spaces allowing occupancy only to holders of parking permits "B," "C," or "D." Likewise, once granted access to a parking lot within which an authorized space is available, drivers still face the task of locating the particular one or more spaces within what may be a large combined pool of authorized and unauthorized spaces.

Consequently, a need exists for a system and method for verifying that a particular parking space is unoccupied, communicating the availability of that particular space to the municipality and authorized drivers, and upon subsequent occupancy, confirming that the occupying vehicle is authorized to occupy the space.

In an embodiment, the invention described herein is a mobile-device application that uses user interfaces, geofence locations, parking sensors, with or without electronic beacons to verify that a particular parking space is unoccupied, communicate such unoccupied and available status to parking authorities and authorized users, confirm subsequent authorized use and in the case of unauthorized use, notify parking authorities for corrective action.

In an exemplary embodiment, the passengers in a vehicle may receive preferential parking in areas designated for members of the RideFlag system who enter one or more areas delimited by a geofence location. As the vehicle containing RideFlag users enters a geofenced location, parking lot, or other designated physical area, the RideFlag system may validate parking permission based on a carpooling effort tracked and confirmed at location via a geofence. The devices associated with the driver and all passengers in a vehicle may transmit a verification of location when entering an area delimited by a pre-determined geofence. In a non-limiting example, users may be given a permit for preferred parking when entering a geofenced parking area located at an office building. The driver and passengers will receive a message on their mobile devices that the vehicle in which they are traveling as members of a validated carpool may now park at a preferred parking area. In a non-limiting example, a preferred parking area or facility may have a designated section or dedicated parking slots exclusively for the use of RideFlag users. The RideFlag system will have received information about a carpool vehicle that has been validated for parking in the reserved area, and will manage the inventory of such parking slots available and occupied as vehicles enter and exit the parking area associated with a particular geofence. The RideFlag system may send a report to the company providing the reserved parking slots to verify that authorized carpooling vehicles have accessed the parking area. The company or a Parking Authority providing the reserved parking area may utilize the report to manage the number of parking awards and number of vehicles parked in the reserved area.

In a non-limiting example, a vehicle parked in a sensor-monitored parking spot may trigger one or more sensors associated with the parking spot. Sensor-monitored parking spots may be located within a pre-determined geofenced area and the sensors may be active to verify the award or right of any particular vehicle to park in the reserved parking area maintained by a Parking Authority. The Parking Authority may provide tiered-access parking spaces to users of a preferred parking system such as, in a non-limiting example, the RideFlag system. A RideFlag central server communicates with one or more sensors to determine space availability for assignment of available spaces to authorized users of the system. Additionally, the RideFlag central server continuously monitors the inventory of available parking spaces, their location, and any premiums associated with the parking spaces for incentives that may be provided to authorized users. The sensor may provide an indication that the previously empty parking spot is now occupied by a vehicle.

In an embodiment, the RideFlag server may determine if there are cars associated with one or more system users that may be geographically within range to receive a transmission from an activated beacon. Upon determining a parking spot is occupied by a vehicle, the sensor may activate a beacon for a set time period, such as, in a non-limiting example, for one minute. When used, the beacon broadcasts a unique code in a very short range to permit a user smart-phone application to collect the beacon signal and report the signal indication to the RideFlag system server. If there are cars associated with one or more users in the area, the RideFlag system may request users within the cars that are within range of the activated beacon signal and/or within range of the one or more sensors associated with the parking space, to respond to a message from the RideFlag server asking if the car associated with the user is currently parked in the recently occupied parking spot. If the user replies in the affirmative, the RideFlag server next determines if the user is authorized to park in the occupied spot. If the user is authorized, the RideFlag system uses this affirmative reply as verification that an authorized RideFlag system user is parked in the occupied spot. The RideFlag system then flags the space as being occupied by an authorized user, updates the user log with the parking notification and reports the authorized use of the parking spot to a parking authority.

Also, if the RideFlag user has been provided with this parking spot as a reward or incentive by the RideFlag system, the RideFlag server will flag the parking slot as occupied by an authorized user having an incentive for use of the parking slot, along with a timestamp as to the start time of the occupation. The timestamp may be associated with entry into a geofenced area, activation of a sensor associated with a parking area, and/or activation of a beacon associated with one or more parking spots. The RideFlag system will manage and maintain the inventory of such incentive based parking slots and the users who have been awarded such incentives.

In a non-limiting example, if no mobile device belonging to an authorized parking candidate is co-located within a geofenced area, with a sensor, or sensor and beacon combination, the server may determine that the vehicle occupying the parking spot is not authorized to park in the occupied spot. If the user is a member of the RideFlag system, but the user is not authorized to park in the indicated slot, the RideFlag system may then transmit a warning message to the user, that they are not authorized to park in the occupied parking spot for this trip and request that they move from the parking spot. If the car is not authorized to occupy the parking spot, or the user is a member of the RideFlag system but is not authorized to occupy the parking spot and the vehicle has not moved from the parking spot, the server may directly notify parking enforcement for tagging or towing, depending on pre-determined enforcement protocol.

In an embodiment, whether an original occupying vehicle is authorized or unauthorized to occupy a given parking spot, once it is removed from the spot, or the vehicle is moved out of an area bounded by a pre-determined geofence location, the movement, sensors, or sensor and beacon in combination allow for real-time return of the parking spot to available parking spot inventory maintained within the RideFlag central server. In a non-limiting example, the movement of a vehicle out of a geofenced area provides an indication to the RideFlag server that a parking spot in the geofenced area is no longer occupied and is returned to the unoccupied inventory for that given geofenced area. In another non-limiting example, a sensor associated with a parking spot within a designated parking area transmits a message to the RideFlag server to indicate that the parking space is once again unoccupied and available. As such, a subsequent authorized parking candidate may be directed to the now-open-spot by receiving communications via the associated RideFlag mobile application on his or her mobile device.

In an embodiment, the mobile application of the instant innovation may be embedded in any other mobile application to allow for an enhanced pool of authorized parking candidates. Such embedding in other mobile applications may be used by third parties on third party applications to offer privileged parking access within the third parties' own platform and using the third party's own branding.

The combination of geofenced designation, a sensor, or sensor coupled with a beacon, a mobile-device application, and a server with tracking, geo-location, inventory management, and real-time messaging to parking authorities can allow municipalities and private entities to offer privileged parking to qualification-verifiable drivers through the use of the disclosed system and process. The system may also allow drivers to receive privileges or rewards based upon pre-determined criteria, and may allow parking enforcement authorities to raise additional revenue through fines levied against vehicles parked where unauthorized to do so.

Turning now to FIG. 1, a process flow diagram for an exemplary system operation consistent with certain embodiments of the present invention is shown. At 100, a Parking Authority, such as a municipality or a private entity offering vehicle parking spaces to the driving public or a sub-set of the driving public offers Tiered-Access Parking Spaces. Tiered-Access parking may be associated with a particular physical location of a parking area as delimited by an established geofence. In an embodiment, such Tiered-Access may be based upon a variety of differentiating criteria, including but not limited to payment of a fee, granting of a reward, or determination of a disability. At 102, the Parking Authority marks each Tiered-Access Space with an electronic Sensor coupled with an electronic Beacon. At 104, Preferred Guests Use an Application pre-downloaded on each guest's mobile device to register for Authorized Space Access. At 106, the Sensor and Beacon communicate the Availability of any given Tiered-Access Space to a Server. At 108, the Server communicates the locations of available Tiered-Access Spaces to Preferred Guests. The Preferred Guest may then elect to occupy one of the identified spaces.

Figure 2:
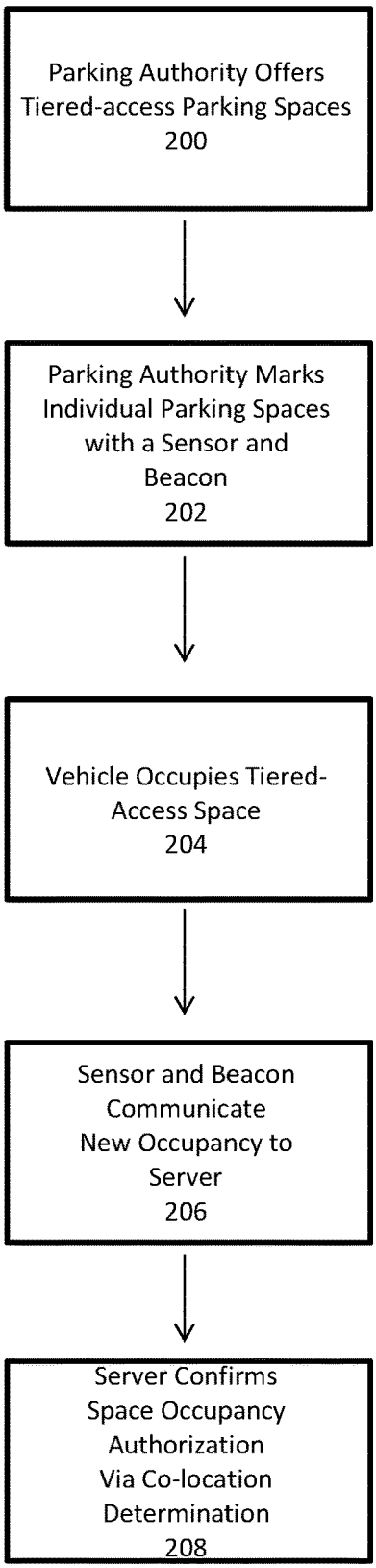
FIG. 2 is a process flow diagram for an exemplary system operation consistent with certain embodiments of the present invention.

Turning now to FIG. 2, a process flow diagram for an exemplary system operation consistent with certain embodiments of the present invention is shown. At 200, a Parking Authority, such as a municipality or a private entity offering vehicle parking spaces to the driving public or a sub-set of the driving public offers Tiered-Access Parking Spaces. In an embodiment, such Tiered-Access may be based upon a variety of differentiating criteria, including but not limited to payment of a fee, granting of a reward, or determination of a disability. At 202, the Parking Authority marks each Tiered-Access Space with an electronic Sensor or and electronic Sensor coupled with an electronic Beacon. At 204, a Vehicle Occupies a Tiered-Access Space. At 206, the Sensor and/or Beacon communicate the New Occupancy of the space to a Server. At 208, the Server makes a Co-Location Determination of the Tiered-Access Space and an Authorized Application-Bearing Mobile Device to determine whether the vehicle occupying the space is authorized to do so. In an embodiment, each Sensor and/or Beacon and Sensor combination is uniquely identified as being associated with a particular parking space of known location. In a non-limiting embodiment, the location of an Authorized Application-Bearing Mobile Device may be determined wholly or in part by use of GPS. The Server compares location data from the Sensor or Beacon and Sensor combination to location data from the Mobile Device to determine Co-Location of the Sensor or Beacon and Sensor combination and the Mobile Device.

Figure 3:
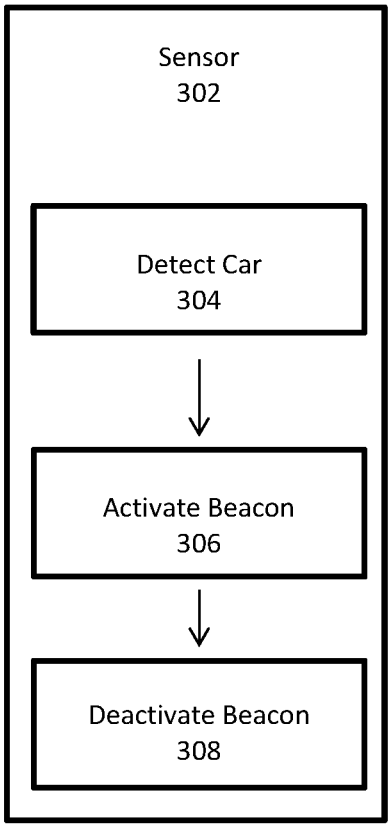
FIG. 3 is a system flow diagram for inter-operation of a parking space sensor and a communication beacon consistent with certain embodiments of the present invention.

Turning now to FIG. 3, a system flow diagram for inter-operation of a parking space sensor and a communication beacon consistent with certain embodiments of the present invention is shown. In an embodiment, Sensor 302 detects the presence of a vehicle (such as, in a non-limiting example, a car) and at 306 Sensor activates a Beacon. The Beacon may communicate with a Server via wired or wireless technology. In an embodiment, once the Beacon has communicated with the Server, the Sensor may Deactivate the Beacon to, by way of non-limiting example, preserve battery life.

Figure 4:
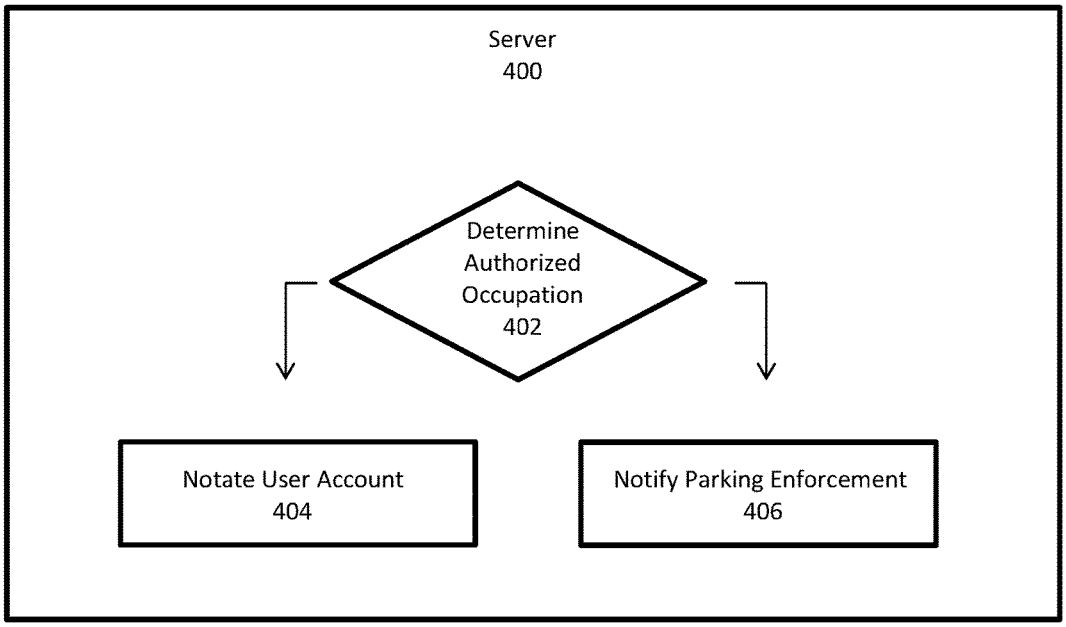
FIG. 4 is a system flow diagram for operation of a server in communication with the coupled sensor and beacon and a mobile application consistent with certain embodiments of the present invention.

Turning now to FIG. 4, a system flow diagram for inter-operation of a server in communication with the coupled sensor and beacon and a mobile application consistent with certain embodiments of the present invention is shown. In an embodiment, Server 400 determines at 402 whether a particular vehicle is authorized to occupy a particular Tiered-Access Parking Space. In a non-limiting example, the Server may make such a determination based upon a precedent determination of Sensor or Beacon and Sensor combination and authorized Application-Bearing Mobile Device Co-location. In an embodiment, each Sensor, singly or in association with a paired Beacon, is uniquely identified as being associated with a particular parking space of known location. In a non-limiting embodiment, the location of an Authorized Application-Bearing Mobile Device may be determined wholly or in part by use of GPS. The Server compares location data from the Sensor or Beacon and Sensor combination to location data from the Mobile Device to determine Co-Location of the Sensor or Beacon and Sensor combination and the Mobile Device. If the Occupation is determined to be authorized, at 404 the Server makes the appropriate notation in the Authorized User's Mobile Application Account. If the Occupation is determined to be unauthorized, at 406 the Server notifies Parking Enforcement for appropriate corrective action.

Figure 5:
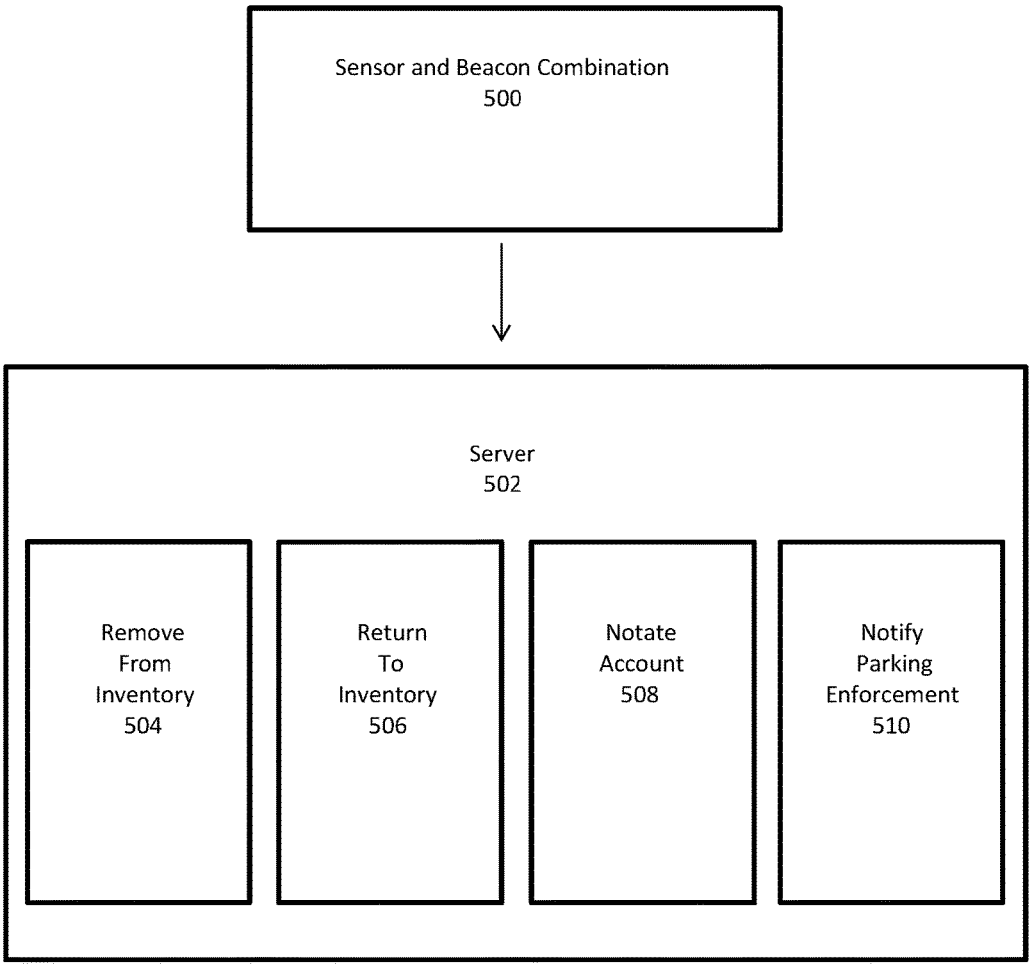
FIG. 5 is a system flow diagram for operation of a sensor and beacon combination in communication with a server, the server configured to take one or more of at least four possible courses of action consistent with certain embodiments of the present invention.

Turning now to FIG. 5, a system flow diagram for operation of a sensor and beacon combination in communication with a server, the server configured to take one or more of at least four possible courses of action consistent with certain embodiments of the present invention is shown. At 500, the Sensor or Sensor and Beacon combination communicates with the Server 502. Based wholly or in part on information so communicated, Server 502 may Remove a parking space from Inventory of available spaces at 504. Upon the vacating of an occupied parking space, Server 502 may Return a parking space to Inventory of available spaces at 506. Upon the occupation of a monitored parking space, the Server 502 may Notate in the Account of an Authorized User that the vehicle associated with the user is occupying a monitored parking space at 508. If the vehicle parked in the monitored parking space in not authorized by the Server 502, the Server 502 may Notify Parking Enforcement Authorities of Unauthorized Use within moments of the vehicle occupying the monitored parking space at 510.

While certain illustrative embodiments have been described, it is evident that many alternatives, modifications, permutations and variations will become apparent to those skilled in the art in light of the foregoing description.

We claim:

1. A method of verifying parking space availability and confirming authorized use, comprising:

establishing communication between a system server and one or more mobile devices;

broadcasting location information from one or more sensors associated with one or more particular parking spaces;

broadcasting an authorization to a mobile device to occupy a particular selected parking space;

verifying said one or more mobile devices and said one or more sensors associated with said particular selected parking space are co-located, to verify occupancy of said particular selected parking space by said one or more mobile devices;

delivering communications from said system server to said one or more mobile devices authorizing occupation of a particular selected parking space;

updating in real time the inventory of parking space utilization in an electronic database maintained within said server; and when occupancy verification determines occupancy of said particular selected parking space is not authorized, system server transmitting a notification to parking enforcement for corrective action.

2. The method of claim 1 where the mobile devices include any device equipped with a radio frequency (RF) transmitter module.

3. The method of claim 1 where said one or more sensors operate on optic detection principles.

4. The method of claim 1 where said one or more sensors operate on magnetic detection principles.

5. The method of claim 1, further comprising said system server receiving communication from a beacon associated with said one or more sensors and one or more parking spaces.

6. The method of claim 5 where the system server activates a beacon for a short period of time and then deactivates said beacon to preserve battery life.

7. The method of claim 1 where communications to mobile devices from said system server are received through a mobile application.

8. The method of claim 7 where the mobile application may be integrated into other mobile applications.

9. The method of claim 1 where said verifying co-location of said one or more mobile devices, said one or more sensors and/or said beacon is performed using GPS.

10. A system of verifying parking space availability and confirming authorized use, comprising:

a user interface;

a server having a processor in wireless communication with one or more mobile devices;

broadcasting location information from one or more sensors associated with one or more particular parking spaces;

broadcasting an authorization to a mobile device to occupy a particular selected parking space;

verifying said one or more mobile devices and said one or more sensors associated with said particular selected parking space are co-located, to verify occupancy of said particular selected parking space;

delivering communications from said system server to said one or more mobile devices authorizing occupation of a said particular selected parking space;

updating in real time the inventory of parking space utilization in an electronic database maintained within said server; and when occupancy verification determines occupancy of said particular selected parking space is not authorized, the system server transmitting a notification to parking enforcement for corrective action.

11. The system of claim 10 where the mobile devices include any device equipped with a radio frequency (RF) transmitter module.

12. The system of claim 10 where said one or more sensors operate on optic detection principles.

13. The system of claim 10 where the one or more sensors operate on magnetic detection principles.

14. The system of claim 10, further comprising said system server receiving communication from a beacon associated with said one or more sensors and one or more parking spaces.

15. The system of claim 14 where the server activates the beacon for a short period of time and then deactivates the beacon to preserve battery life.

16. The system of claim 10 where communications to mobile devices from said system server are received through a mobile application.

17. The system of claim 16 where the mobile application may be integrated into other mobile applications.

18. The method of claim 10 where said verifying co-location of said one or more mobile devices, said one or more sensors and/or said beacon is performed using GPS.

* * * * *